US009032857B2

(12) United States Patent
Amiet et al.

(10) Patent No.: US 9,032,857 B2
(45) Date of Patent: May 19, 2015

(54) ELECTROMAGNETIC RAIL LAUNCHERS AND ASSOCIATED PROJECTILE-LAUNCHING METHOD

(75) Inventors: Michel Amiet, Paris (FR); Pascal Tixador, Grenoble Cedex (FR); Arnaud Badel, Bellgarde (FR)

(73) Assignee: ETAT FRANCAIS REPRESENTE PAR LE DELEGUE GENERAL POUR L'ARMEMENT, Bagneux (FR)

( * ) Notice: Subject to any disclaimer, the term of this patent is extended or adjusted under 35 U.S.C. 154(b) by 15 days.

(21) Appl. No.: 14/114,812

(22) PCT Filed: Dec. 20, 2011

(86) PCT No.: PCT/FR2011/000664

§ 371 (c)(1),
(2), (4) Date: Oct. 30, 2013

(87) PCT Pub. No.: WO2012/095564

PCT Pub. Date: Jul. 19, 2012

(65) Prior Publication Data

US 2014/0103746 A1 Apr. 17, 2014

(30) Foreign Application Priority Data

Jan. 13, 2011 (FR) ..... 11 00111

(51) Int. Cl.
*F41B 6/00* (2006.01)

(52) U.S. Cl.
CPC ..... *F41B 6/006* (2013.01); *F41B 6/003* (2013.01)

(58) Field of Classification Search
USPC ..... 89/8; 124/3
See application file for complete search history.

(56) References Cited

U.S. PATENT DOCUMENTS

| | | | | |
|---|---|---|---|---|
| 4,796,511 | A | 1/1989 | Eyssa | |
| 4,813,332 | A * | 3/1989 | Jasper, Jr. | 89/8 |
| 4,858,511 | A * | 8/1989 | Jasper, Jr. | 89/8 |
| 4,858,512 | A * | 8/1989 | Jasper, Jr. | 89/8 |
| 4,967,639 | A | 11/1990 | Hughes et al. | |
| 4,986,160 | A | 1/1991 | Kemeny | |
| 5,173,568 | A * | 12/1992 | Parmer | 89/8 |

OTHER PUBLICATIONS

International Search Report dated Apr. 18, 2012, corresponding to PCT/FR2011/000664.
Boris Bellin's thesis dated Sep. 29, 2006, entitled "Contributions to the Study of Superconductor Coils: The DGA Project of the Impulse HTS SMES" ("Contributions A L'Etude Des Bobinages Supraconducteurs : Le Projet DGA DU SMES HTS Impulsionnel").

* cited by examiner

*Primary Examiner* — Jonathan C Weber
(74) *Attorney, Agent, or Firm* — Young & Thompson

(57) ABSTRACT

The present invention relates to the field of electromagnetic rail launchers, and particularly to a rail launcher and an associated projectile-launching process including at least two longitudinal rails connected to a power supply circuit of these two rails, these rails being at least partially surrounded by superconductor elements able to generate a magnetic induction of a direction perpendicular to the plane formed by the rails and located therebetween during the flow of a current therein, launcher wherein the supply circuit includes the superconductor elements.

13 Claims, 9 Drawing Sheets

ELECTROMAGNETIC RAIL LAUNCHERS AND ASSOCIATED PROJECTILE-LAUNCHING METHOD

FIELD OF THE INVENTION

The present invention relates to the field of electromagnetic rail launchers, including electromagnetic rail launchers and more particularly electromagnetic rail guns for the launching of projectiles, and more particularly to a launcher incorporating a coil able to generate a driving force on a projectile.

To meet the current objectives of speed and payload by using only a pair of parallel rails, extremely high intensity currents have to be implemented to launch a projectile at high speed (greater than 3 km/s): the ideal impulse is created by currents from 100 kA to 10 MA for periods generally from a few tenths of a ms to a few tens of ms.

BACKGROUND OF THE INVENTION

At present, and in the absence of appropriate power sources, the launchers are powered by capacitors, i.e. impulse voltage sources. These sources are adapted to the charge via a shaping circuit constituted by an inductor and a resistor. This shaping circuit is necessary to limit the current peak during the launching, while ensuring a fast increase thereof to the assigned value.

The total resistance of the circuit is made significant by the use of a strong inductance coil, i.e. a long length of wire. Since the ratio between the inductance and the resistance of a coil depends, in a first approximation, only on the volume thereof, it is difficult to significantly reduce the total resistance of the circuit while keeping a sufficient inductance and a reasonable volume.

The circuit resistance causes considerable losses through Joule effect, the energy efficiency of the system is thus quite low.

Only 3% of the stored energy in the capacitors is effectively transferred to the mobile. 90% of this energy is dissipated through Joule effect, but only a few percent is actually usefully used by the launcher. However, for large launchers, an efficiency of 30% can be obtained in some cases.

At first sight, the weak efficiency is not a critical point, since the involved energies are not very important: from a few tenths of a kJ for a small launcher to a few MJ for large-size launchers.

In fact, it is a crucial point. Indeed, there is no storage device able to provide both a high power density and a high energy density.

To have a high power, the current technology provides a low energy density storage. This is the case for capacitors for powering the launcher.

The low efficiency therefore causes limited energy losses, but the cost in volume and mass is very significant. Moreover, these losses cause the temperature rise of the launcher during launching, which complicates its design and makes the launching operation of projectiles with a high rate difficult.

Furthermore, homopolar or synchronous generators are known, which allows, for their part, to reach densities of 100 $MJ/m^3$, but which require to use switches cutting currents greater than 1 MA, thereby requiring an extremely complex technology.

Superconductor power supplies are also known, which have a high energy density, namely in the order of 10 $MJ/m^3$, such as the SMES-type ones described for example in Boris Bellin's thesis dated Sep. 29, 2006, entitled "CONTRIBUTIONS TO THE STUDY OF SUPERCONDUCTOR COILS: THE DGA PROJECT OF THE IMPULSE HTS SMES" ("CONTRIBUTIONS A L'ETUDE DES BOBINAGES SUPRACONDUCTEURS: LE PROJET DGA DU SMES HTS IMPULSIONNEL").

Furthermore, in order to reduce the value of the supply current intensity of the rails, is known U.S. Pat. No. 4,796,511, which describes an electromagnetic rail gun mainly comprising, as shown in FIG. 1:

- two longitudinal rails 13 and 14 powered by reverse current by a homopolar source 34,
- two longitudinal superconductor dipolar electromagnets 26 connected to each other at each of their ends by superconductor connecting means 27, one of which is connected to an interface itself connectable to electrical means for generating an electrical current, wherein the rails and the electromagnets are concentrically arranged, the latter being thermally insulated from the rest and cooled for example by liquid helium.

It is further indicated that these electromagnets have the same advantages as a superconductor coil.

During the launching of a projectile, the latter is, for example, arranged in a sabot comprising armatures in contact with said rails, which is itself positioned at one of the ends of the gun. The current generated by the source 35 is then injected in the rails by closing the switch 35 thus generating a first Laplace force on the sabot which is then accelerated within the gun. At the same time, the flow of a current in the superconductor electromagnets generates a second Laplace force on the sabot, complementary to the first one and allowing to increase the acceleration of the projectile within the gun. Thus, by placing adjacently to the rails conductors or coils which conduct the current in the same direction as the rails, the energy transferred to the projectile can be maintained, while reducing the required current supplied to the rails.

Such a gun enables, in relation to a gun using only two parallel rails, to lower the current intensity to be injected in the rails and thus to use current sources other than capacitors and to obtain higher energy efficiencies.

SUMMARY OF THE INVENTION

The purpose of the invention is to further increase the energy efficiency of rail launchers and to increase their compactness, and to allow the use of proven and simple technology components.

The provided solution is a rail launcher comprising at least two longitudinal rails connected to a power supply circuit of these two rails, these rails being at least partially surrounded by superconductor means able to generate a magnetic induction of a direction perpendicular to the plane formed by the rails and located therebetween during the flow of a current therein, launcher wherein said supply circuit comprises the superconductor means.

According to a particular feature, the supply circuit comprises connecting means between the superconductor means and the rails, and the superconductor means, the rails and at least a part of the electrical connecting means are able to form a closed electrical circuit.

According to a particular feature, the superconductor means are electrically connected to the supply circuit of the rails or to these two rails and able to simultaneously generate said magnetic induction during the flow of a current therein and to supply the rails with this current.

According to an additional feature enabling to perform successive launchings, a launcher according to the invention comprises at least one current generator able to charge said superconductor means.

According to a particular feature, the superconductor means comprise at least one superconductor coil or at least one dipolar electromagnet.

According to another feature, said at least one superconductor coil is, at least in part, in the shape of a loop for example in the shape of a planar or curved 0, or in the shape of an 8 wound on itself.

According to another feature, said at least one superconductor coil is of the SMES-type.

According to another feature enabling to increase the efficiency of the launcher, each of the rails is segmented into at least two segments, the respective segments of one of the rails facing those of the other rail, thereby forming pairs of segments and, preferably at least one superconductor coil is associated to each of the pairs of segments, each pair of rails with its corresponding coil thus forming a module, the launcher comprising at least two modules arranged either in parallel or arranged coaxially in series.

According to another feature useful especially when extremely intense currents, for example of 1 MA or more, have to be generated in the rails, a launcher according to the invention can comprise a current generator able to power the rails, for example connected to the supply circuit and/or to the rails.

The invention also relates to a projectile-launching process with an electromagnetic launcher comprising at least two longitudinal rails connected to a power supply circuit comprising superconductor means of these two rails, these rails being at least partially surrounded by superconductor means able to generate a magnetic induction of a direction perpendicular to the plane formed by the rails and located therebetween during the flow of a current I1 therein, said process comprising, during the launching of the projectile, the simultaneous following steps:

generating said current I1 within the superconductor means, injecting this current in said at least two rails.

According to a particular feature, a process according to the invention comprises a preliminary step to store energy in the superconductor means from a current generator.

BRIEF DESCRIPTION OF THE DRAWINGS

Other advantages and features will become apparent in the description of an embodiment of the invention with reference to FIGS. 2 to 9, in which.

DETAILED DESCRIPTION OF THE INVENTION

Figure 1:
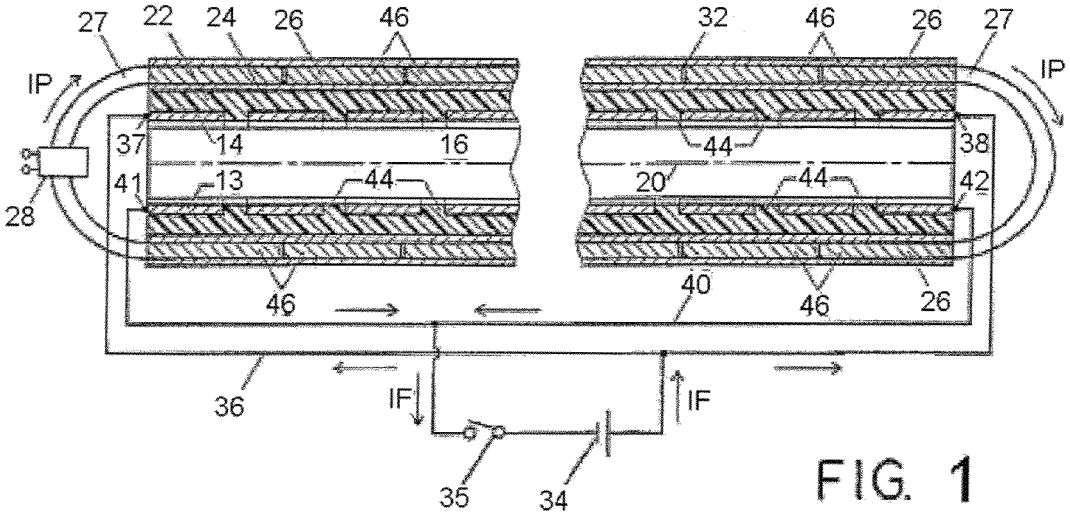
FIG. 1 PRIOR ART
FIG. 1 illustrates a prior art electromagnetic rail gun.
Figure 2:
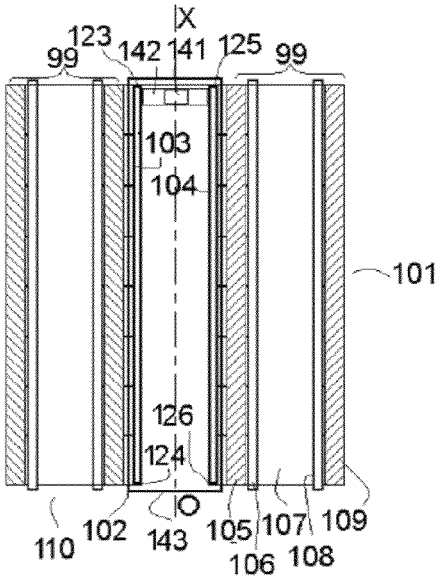
FIG. 2 shows a diagram of an electromagnetic rail launcher according to a first embodiment of the invention.

FIG. 2 shows a diagram of an electromagnetic rail launcher according to a first embodiment of the invention. This electromagnetic launcher 101 comprises:

a tubular structure 102 of an axis OX, first and second electrically conducting rails 103 and 104, arranged longitudinally and symmetrically with respect to the axis OX and inside and close to the tubular structure, a power supply circuit of said rails 103 and 104, this circuit especially comprising superconductor means 99 able to generate a magnetic induction of a direction perpendicular to the plane formed by the rails and located therebetween during the flow of a current therein, and concentrically arranged around the tubular structure, thus also around said rails 103 and 104.

The superconductor means 99 comprise an assembly 110 of concentrically arranged successive layers, namely, from the tubular structure 102, a first thermally insulating layer 105, a first cryogenic structure 106, a superconductor coil 107, a second cryogenic structure 108, and a second thermally insulating layer 109.

Figure 3A:
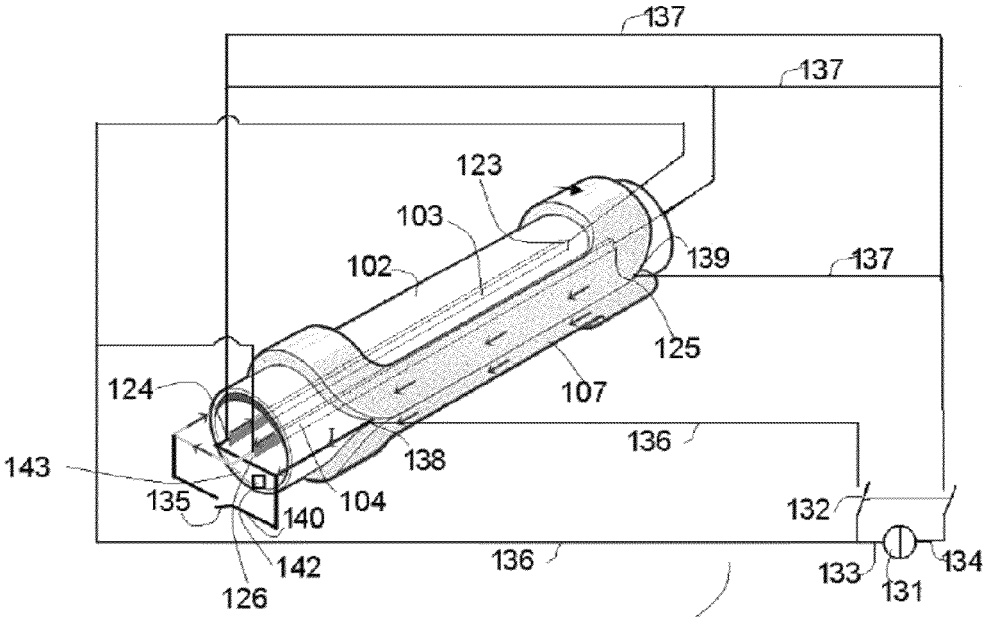
FIG. 3*a* shows an example of a schematic diagram of a power supply circuit of said rails as well as an example of a shape which could be given to the superconductor coil, while FIG. 3*b* more particularly shows an example of a shape of the coil
Figure 3B:
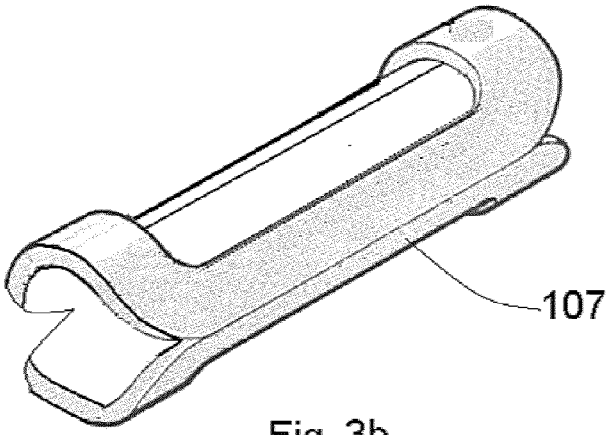
FIG. 3*c* shows its shape if it was brought in a plane.
Figure 3C:
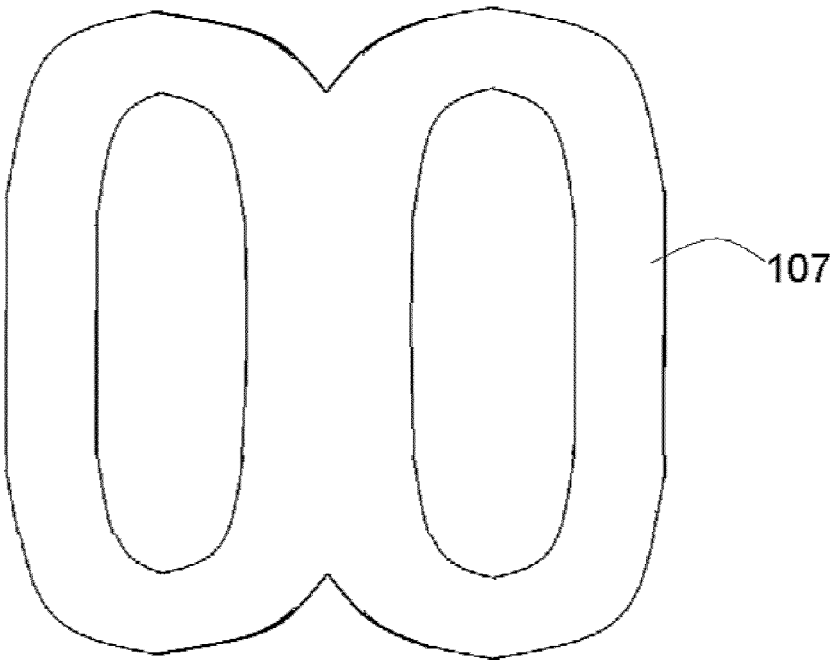

FIG. 3*a* shows an example of a current supply circuit 130 of said rails 103 and 104 as well as an example of a shape which could be given to the superconductor coil 107, while FIG. 3*b* only shows the shape of the coil and FIG. 3*c* its shape if it was brought in a plane. For clarity purposes, only the rails, the tubular structure and the superconductor coils are shown on FIG. 3*a*.

This supply circuit 130 of the rails 103, 104 is provided, apart from the superconductor coil 107 of the superconductor means 99, with a current generator 131, first switch-type means 132, able to simultaneously open and close the outlet 134 and the inlet 133 of the generator 131, thus to allow its electrical insulation when they are open. In addition, the supply 131 is connected, on the one hand, by first electrical connecting means 136 to a first end 123 of the first rail 103, to a second end 126 of the second rail 104 as well as to a first end 139 of the coil 107, and, on the other hand, by second electrical connecting means 137 to the second end 124 of the first rail 103, to the first end 125 of the second rail 104 as well as to a second end 138 of the coil 107. Furthermore, second switch-type means 135 are arranged on third electrical connecting means 140 connecting the first to the second electrical connecting means, connections 136 to the connections 137.

At the muzzle 143 of the gun are arranged a projectile exit detector 142 and an associated control logic able to control the closing of the second switch-type means 135 upon detection of a projectile exit, and this, in order to preserve the energy remaining in the superconductor coil and to avoid the formation of an electrical arc and possibly to power other rails.

As shown in FIG. 3*c*, brought in a plane, the superconductor coil 107 forms two loops 141 integral with each other so as to form an 8, while the actual shape is this same shape wound on itself as shown in FIG. 3*b*.

The operation of this launcher is the following:

Firstly, the first means 132 are closed while the second means 35 are opened; the coil 107 is then powered by the generator 131 until obtaining the rated current. Then, the second means 135 are closed: the current delivered by the generator decreases and then the first means 132 are opened; the energy stored in the superconductor coil 107 is thus preserved in the latter with almost zero losses. Thus, this coil charge can possibly be performed some time (minutes to hours) before the launching. Accordingly, at the launching, the current generator 131 is not essential and could have been placed on another launcher to charge the corresponding coil. The coil 107 being thus charged, when one desires to use this energy to launch the projectile 141, it is sufficient to open the second means 135 and the rails are thus powered. In this conformation, the coil, the rails, and the first, second and third electrical connecting means 136, 137 and 140 form an electrically closed circuit.

Figure 4:
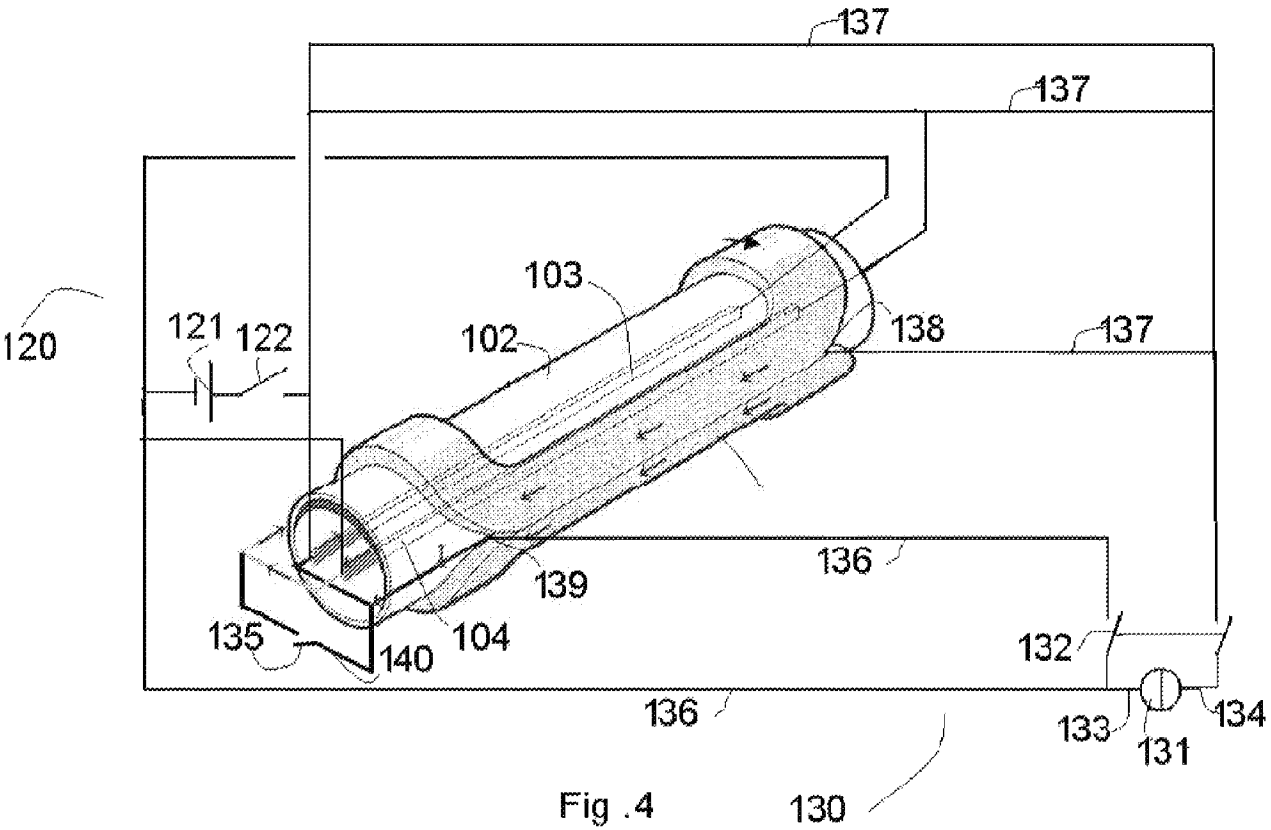
FIG. 4 shows a second embodiment of a schematic diagram of the supply circuit of the rails.

FIG. 4 shows a second embodiment of a schematic diagram of the supply circuit of the rails 103 and 104 comprising, in addition to the means shown in FIG. 3*a*, a second supply circuit 120 of the rails 103 and 104 comprising a current generator 121, switch-type means 122, able to open and close this circuit. The current generator 121 is connected, on the one hand, to the first one 123 of the ends 123, 124 of the first rail 103 as well as to the opposite end 126 of the second rail 104, called second end 126 of the second rail 104, and, on the other hand, to the second end 124 of the first rail 103 as well as to the opposite end 125 of the second rail 104, called first end 125 of the second rail 104.

The presence of this second supply circuit enables, in relation to the circuit of FIG. 3*a* in which only the coil powered the rails with current, to increase the total current intensity able to be injected in the rails, this intensity being constituted by the sum of the current I1 generated by the superconductor coil 107 and the current I2 generated by the current generator 121. This second circuit can be used when the intensity I1 of the current generated by the superconductor coil is not sufficient for the envisaged application.

The operation of this launcher is the following:

Firstly, the first means 132 are closed while the second means 135 are opened; the coil 107 is then powered by the current generator 131 until obtaining the rated current. Then, the second means 135 are closed: the current delivered by the current generator decreases and then the first means 132 are opened; the energy stored in the superconductor coil 107 is thus preserved in the latter with almost zero losses. Furthermore, the current generator 121 of the second circuit is set to provide the rails with a complementary intensity I2 so that the total intensity injected in the rails is equal to I1+I2. According to the desired total intensity, the superconductor coil 107 can provide up to 100% of this intensity.

In a second step, when it is desired to launch the projectile 141 arranged on a sabot 142 placed at the end of the gun opposite to its muzzle 143 and in contact with each of the first and second rails 103 and 104, it is sufficient to simultaneously close the switch-type means 122 of the first electrical circuit 120 and open the second means 135 of the second circuit 130.

Thus, the rails are powered, on the one hand, by the intensity current I2 provided by the current generator 121 and by the current I1 provided by the superconductor coil 107.

The sabot 42 and the projectile are then accelerated by the Laplace force exerting on them through the magnetic induction $B_{12}$ generated by the flow of the current (I1+I2) passing between the first and second rails and 4 via the sabot 42 and the one produced by the magnetic induction $B_3$ exerted on the sabot-projectile assembly generated by the flow of current I2 in the superconductor coil 7.

Figure 5:
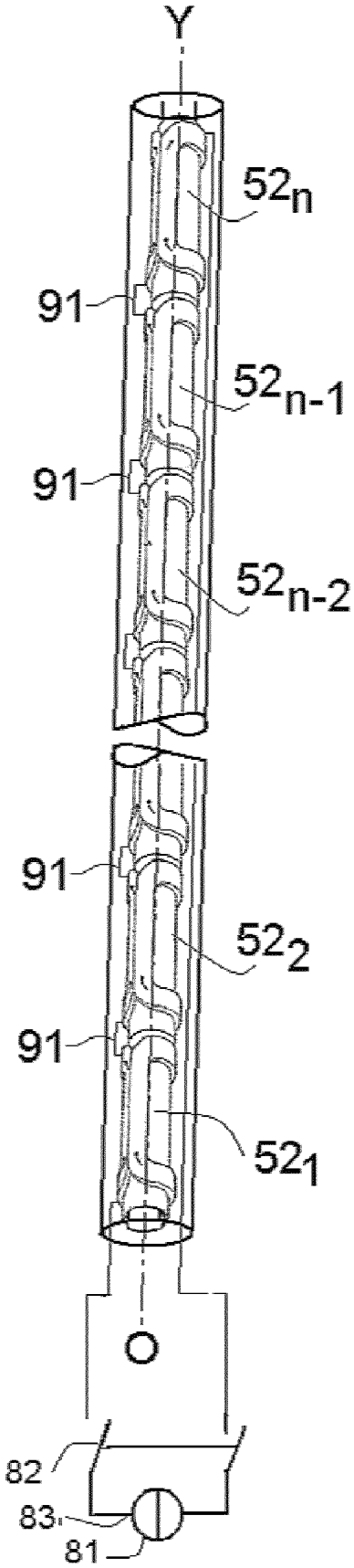
FIG. 5 shows another embodiment of the invention.

FIG. 5 shows another embodiment of the invention allowing to increase the efficiency with respect to a launcher according to FIG. 3*a* and to simplify the construction by implementing, for most circuits, a lower intensity.

For clarity purposes, only the rails, the tubular structure and the superconductor coils are shown.

This electromagnetic launcher 51 is provided with a tubular structure of an axis OY comprised of successive modules $\mathbf{52}_1$ to $\mathbf{52}_n$, similar to that of FIG. 3*a* and arranged in series and coaxially one after the other, and of an axis OX coaxial to the axis OY so that, upon launching, the sabot is successively accelerated by the successive modules $\mathbf{51}_1$ to $\mathbf{52}_n$.

Figure 6:
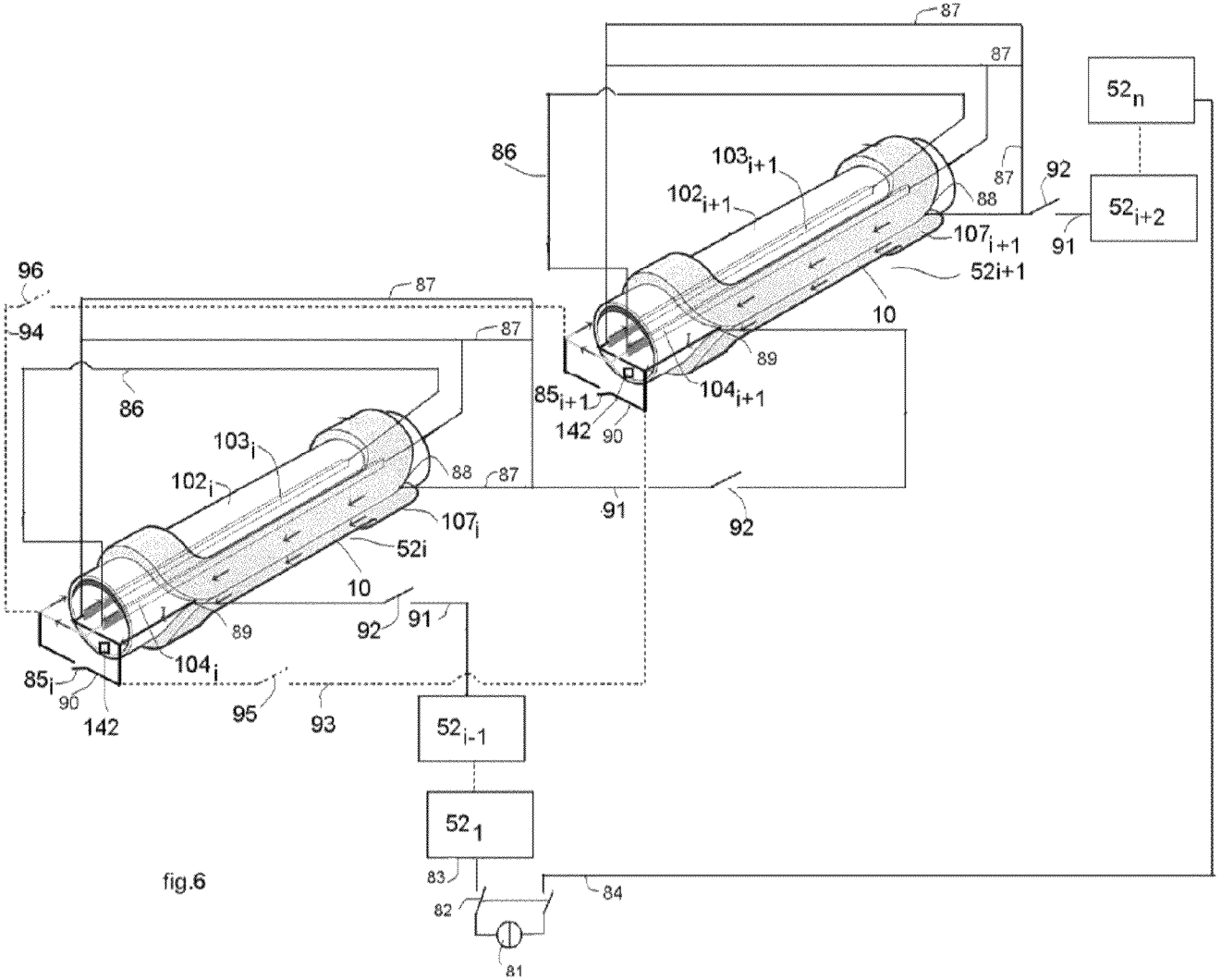
FIG. 6 shows a schematic diagram of a supply circuit of the launcher according to FIG. 5.

As shown in FIG. 6 which shows a diagram of a supply circuit of the launcher, each module $\mathbf{52}_i$ comprises two rails $\mathbf{103}_i$ and $\mathbf{104}_i$ arranged within a tubular structure around which superconductor means $\mathbf{102}_i$ are arranged and especially comprising a cryostat and a superconductor coil $\mathbf{107}_i$. This circuit is provided with:

- a first circuit for charging the superconductor coils $\mathbf{107}_i$ comprising a current generator 81, first switch-type means 82 and electrical connecting means 83 and 84 to the coil $\mathbf{107}_1$ of the first module $\mathbf{52}_1$, and to the coil $\mathbf{107}_n$ of the last module $\mathbf{52}_n$, respectively. Furthermore, the successive coils are connected to each other by an electrical connection 91 which comprises second switch-type means 92, these elements being able to form, with the superconductor coils, an electrically closed circuit able to charge the superconductor coils of the launcher 51 in series,
- a second circuit per module $\mathbf{52}_i$ for discharging the corresponding coil $\mathbf{107}_i$ in the corresponding rails $\mathbf{103}_i$ and $\mathbf{104}_i$. Each of these second circuits comprises first electrical connecting means 86 from a first end of the superconductor coil $\mathbf{107}_i$ to a first end of the first rail $\mathbf{103}_i$ and to the opposite end of the second rail $\mathbf{104}_i$, and second electrical connecting means 87 from the second end of the superconductor coil $\mathbf{107}_i$ to the second end of the first rail $\mathbf{103}_i$ and to the opposite end of the second rail $\mathbf{104}_i$. Furthermore, third switch-type means $\mathbf{85}_i$ are arranged on third electrical connecting means 90 connecting the first electrical connecting means 86 to the second electrical connecting means 87.

Moreover, optionally, fourth and fifth electrical connecting means 93, 94 are shown in dotted lines, each comprising fourth and fifth switch-type means 95, 96 and connecting the first electrical connecting means 86 of the module $\mathbf{52}_i$ to the first electrical connecting means 86 of the module $\mathbf{52}_{i+1}$ and the second electrical connecting means 87 of the module $\mathbf{52}_i$ to the second electrical connecting means 87 of the module $\mathbf{52}_{i+1}$, respectively.

The operation of this launcher is the following:

Firstly, the first and second switch-type means 82, 92 are closed while the third, fourth and fifth switch-type means $\mathbf{85}_i$, 95, 96 are opened. The coils $\mathbf{107}_i$ are then powered with current by the current generator 82 until obtaining the rated current. Then, the third means $\mathbf{85}_i$ are closed: the current delivered by the generator decreases, and then the first switch-type means 82 are opened; the energy stored in each of the superconductor coils $\mathbf{107}_i$ is then preserved therein with almost zero losses.

In a second step, when it is desired to launch a projectile arranged on a sabot placed in contact with both rails $\mathbf{103}_1$ and $\mathbf{104}_1$ at the end of the launcher opposite to its muzzle, it is sufficient to control the closing of all third switch-type means $\mathbf{85}_i$.

To improve the efficiency, it is possible, on the one hand, to sequentially close the third switch-type means $\mathbf{85}_i$ depending on the position of the sabot and the module to be powered with current to accelerate the projectile.

In the latter case, the projectile to be launched being arranged on a sabot placed at the end of the launcher opposite to its muzzle, in this case to one of the ends of the first module $\mathbf{52}_1$, closing of the third means $\mathbf{85}_1$ of this first module causes the current supply of the rails $\mathbf{103}_1$ and $\mathbf{104}_1$ from the discharge of the coil $\mathbf{107}_1$, which produces a Laplace force which accelerates the sabot in the direction of the second module. Furthermore, the induction produced by the discharge of the coil $\mathbf{107}_1$ participates in the acceleration of the sabot.

When the sabot reaches the end of the first module, it is detected by the detection means 142 which control the closing of the third means $\mathbf{85}_1$, the coil $\mathbf{107}_2$ being then able to power the rails $\mathbf{103}_1$ and $\mathbf{104}_1$, which produces a Laplace force which further accelerates the sabot in the direction of the third module. In addition, the induction produced by the discharge of the coil $\mathbf{107}_2$ also participates in the acceleration of the sabot. The same process is performed for all the following modules, and that, from the first to the last one $\mathbf{52}_n$.

The projectile exits from the launcher and is separated from the sabot at the exit of the last module $\mathbf{52}_n$. Thus, all coils are discharged one after the other depending on the position of the projectile, thereby enabling an almost consistent acceleration of the sabot and thus of the projectile.

Closing of the third means $\mathbf{85}_i$ controlled by the detection means 142 when the projectile exits from the module $\mathbf{52}_1$ enables to preserve the energy remaining in the superconductor coil, to avoid the formation of an electrical arc and possibly to power the rails of the following module by controlling the closing of the fourth and fifth switch-type means 95, 96 closing other rails of the following module, as shown in FIG. 6 or, in a deferred way, of another module arranged downstream.

Figure 7:
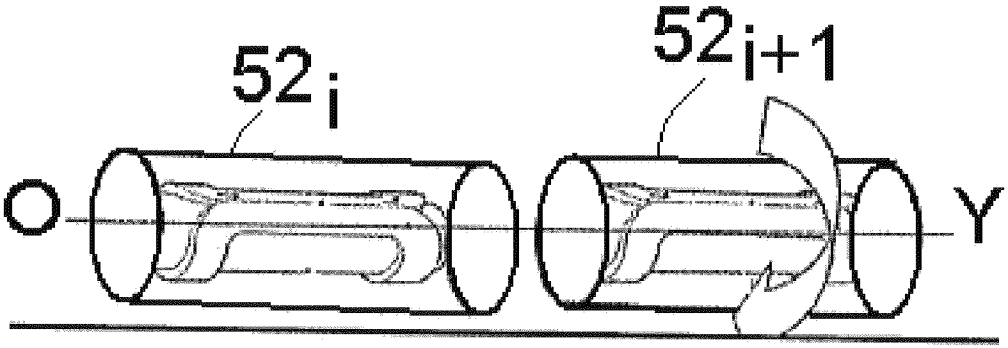
FIG. 7 shows an example of radially offset modules.

Furthermore, at least two successive modules $\mathbf{52}_i$, $\mathbf{52}_{i+1}$, thus in particular the corresponding rails, can be radially offset, for example with an angle of π/2, π/3, π/4, π/6 or π/n radians, as shown in the diagram of FIG. 7 where the second module $\mathbf{52}_i$ is radially offset with respect to the module $\mathbf{52}_{i+1}$ with an angle of about 5 degrees in the direction of the arrow.

Thus, if the sabot includes several brush assemblies arranged with the same angular offset, these assemblies can be implemented one after the other, thereby enabling to always have good electrical contacts between the rails and the brush assemblies. This embodiment can be associated to that of segmented rail launchers.

Figure 8:
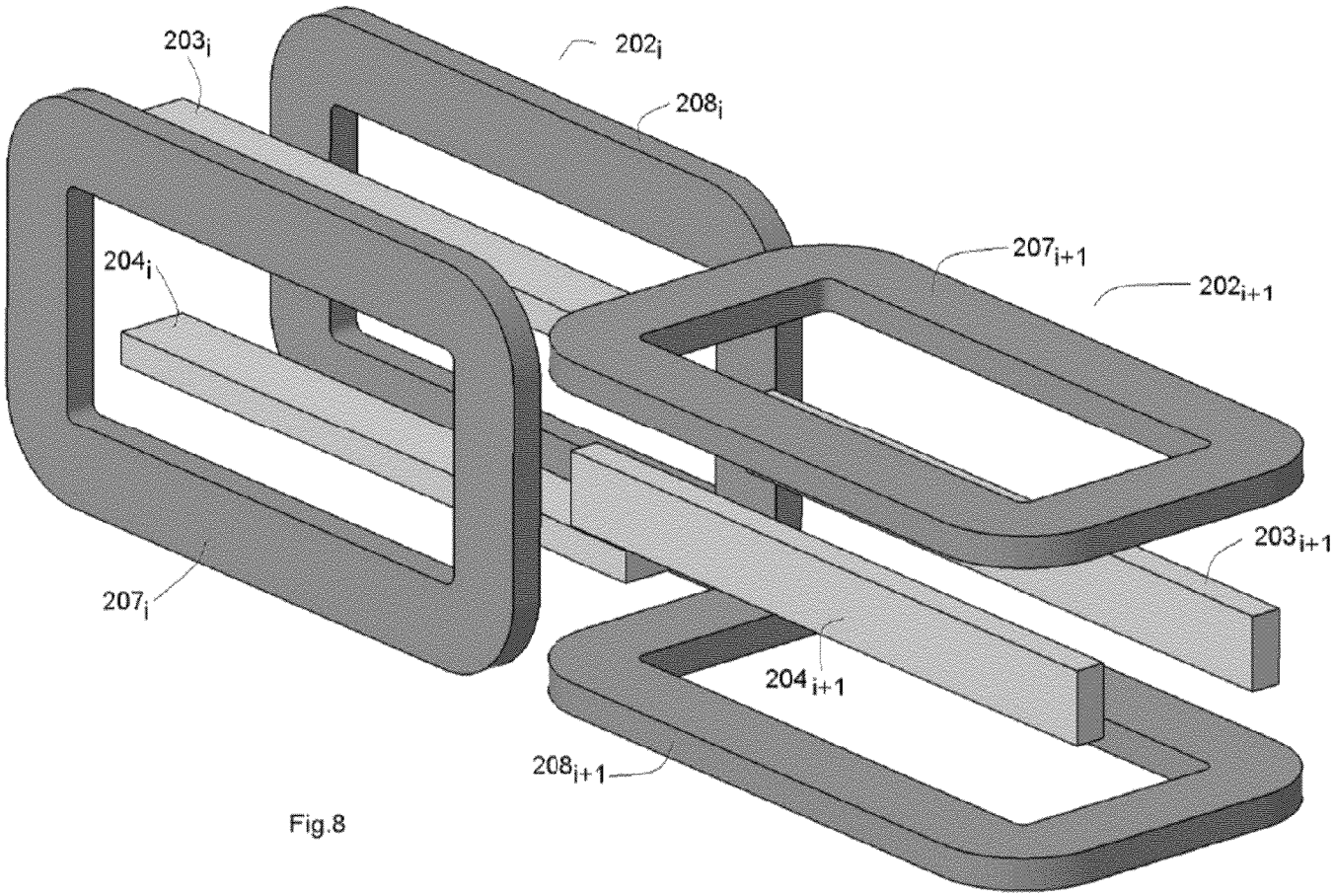
FIG. 8 shows a diagram of an embodiment of a launcher in which, for clarity purposes, only two modules, each with only two rails and two superconductor coils, are shown.

FIG. 8 shows a diagram of an embodiment of a launcher in which, for clarity purposes, only two modules, each comprising only two rails and two superconductor coils, are shown.

This launcher 201 comprises a tubular structure of an axis OY constituted by successive modules $\mathbf{202}_1$ to $\mathbf{202}_n$ arranged one after the other and of an axis OX coaxial to the axis OY such that, upon launching, the sabot is successively accelerated by the successive modules $\mathbf{202}_1$ to $\mathbf{202}_n$.

Each module $\mathbf{202}_i$ is provided with two rails $\mathbf{203}_i$ and $\mathbf{204}_i$ arranged within a tubular structure with a square section not shown and around which superconductor means are arranged, comprising in particular a cryostat and a superconductor coil $\mathbf{207}_i$. In this exemplary embodiment, two loop- or zero-shaped flat coils are arranged in parallel on either sides of the tubular structure and the shown modules $\mathbf{202}_i$ to $\mathbf{202}_{i+1}$ are radially offset with an angle of π/2 rd. The supply circuit of the rails and of the coils can be in accordance with the one shown in FIG. 6.

Figure 9:
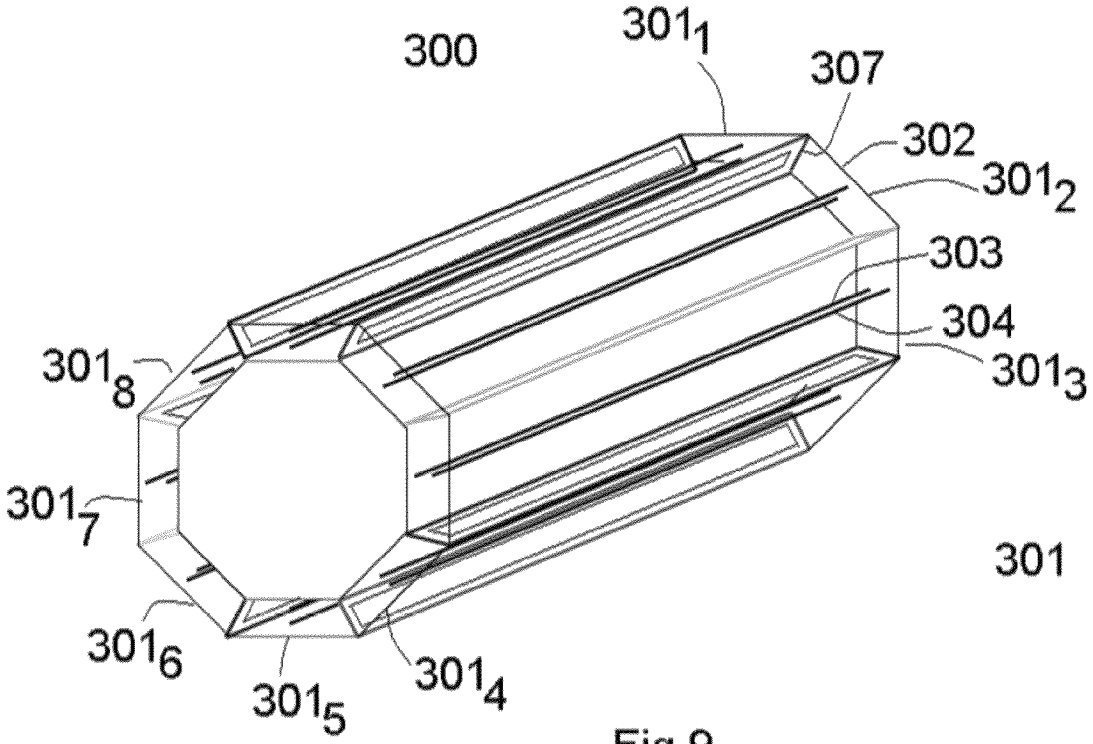
FIG. 9 shows another embodiment of the invention in which launcher modules are arranged in parallel, thereby allowing to launch several projectiles, simultaneously or not.

While FIGS. 6 and 8 show launchers comprising several modules arranged in series, FIG. 9 shows another embodiment of the invention in which modules are arranged in parallel, thereby enabling to simultaneously launch several projectiles.

This launcher 300 is provided with eight trapezoid-shaped modules $\mathbf{301}_1$ to $\mathbf{301}_{8i}$ arranged together so as to form an octagonal toroid. Each module comprises a trapezoid tubular structure 302 in which two rails 303, 304 are arranged and, on the shortest outer edges of which are arranged superconductor means, comprising in particular a cryostat and a superconductor coil 307 in the shape of an elongated loop. In this exemplary embodiment, each of the superconductor means is common to the modules arranged on either sides of these means.

The current supply circuit of the coils and the one for discharging the latter can be of the type of that of FIG. 6 with a power supply of the coils in series to allow their charging and a discharge circuit for each module, with a discharge preferentially in parallel.

Many modifications can be made to the previously described exemplary embodiments without departing from the scope of the invention. Thus, in the example of FIG. 6, a cryostat can be associated to each coil or a single cryostat can be associated to all coils or an intermediate solution can be considered. Moreover, the rails 103 and the rails 104 of the different rails can form only two parallel rails in the launcher and the coils can be discharged in series or in parallel. Thus, using 10 modules each able to generate a current I1 of 100 kA, a total current of 1 MA can be obtained by discharging the coils in parallel. By using the principle of the invention, launching of both small-caliber projectiles and satellites can be performed.

Furthermore, it is possible to use coils comprising no loop. However, the higher the magnetic coupling between the superconductor means and the launcher, the higher the efficiency of the launcher.

Concretely, this requires to find the geometry ensuring that the maximum possible amount of the field lines generated by the coil pass between the rails of the launcher, orthogonally to them. k, the coupling, is defined by:

$$k = \frac{M^2}{L_{lanceur} L_{SC}}$$

with $L_{launcher}$ the maximum inductance reached at the end of the launching

Lsc the inductance of the superconductor assembly.

Thus, the superconductor coil is not optimized for storing energy, as commonly used, but for maximizing the magnetic coupling between the rails and the coil, the resulting geometries being thus of the dipole type, as shown in FIGS. 3*a*, 6, 8, 9, and thus substantially different from that of the conventional SMES-type coils, which are either of the short solenoid type or of the discontinuous toroid type.

A coupling of k=11% is easily obtained by using a traditional dipole, but a coupling of 15% is possible.

Using this concept on a segmented rail launcher is entirely conceivable, to that end it is sufficient to store the energy in several dipoles distributed along the launcher and angularly offset so that the produced field is always in the appropriate direction.

The following table compares the results obtained by a traditional launcher with that of a launcher according to FIGS. 2 and 3, depending on the coupling:

| Traditional launcher | Launcher/SMES without coupling | Launcher/SMES 11% coupling | Launcher/SMES 15% coupling |
|---|---|---|---|

-continued

| | | | | | | | | |
|---|---|---|---|---|---|---|---|---|
| Initial energy | 110 kJ | | | | | | | |
| Start current | 180 kA | | 65 kA | | 25 kA | | 20 kA | |
| Inductance | | | 0.052 mH | | 0.35 mH | | 0.61 mH | |
| Dissipated energy | 107 kJ | 97% | 31.5 kJ | 28% | 7 kJ | 6.4% | 4.6 kJ | 4.2% |
| Kinetic energy | 1.38 kJ | | 1.4 kJ | | 1.39 kJ | | 1.42 kJ | |
| Remaining energy | 2.8 kJ | 2.5% | 75 kJ | 68% | 100 kJ | 91% | 102.5 kJ | 93.2% |
| Final current | | | 54 kA | 83% | 23.9 kA | 95.6% | 19.3 kA | 96.5% |

Compared to a power supply by capacitors, the low power supply losses by the superconductor means enable to obtain an almost consistent current (maximum variation of 15%) during launching. This enables to power the launcher with a current three times lower for a same exit speed, even without coil-launcher coupling.

A good coupling (11 or 15%) enables to improve the acceleration of the mobile and to further win a factor 3 on the current, which in total enables to lower the current by a factor 9 with respect to a traditional power supply by capacitors.

Such a decrease of the current thus allows to directly supply the launcher by superconductor means with the current superconductor hTc technologies.

The efficiency being much higher (close to 90%), a significant decrease of the storage volume can be considered.

The current in the rails and the mobile being lower, the temperature rise thereof will be reduced, thereby enabling to increase the launching frequencies and the rail service life.

Finally, the recharge time will itself also be extremely reduced since 93% of the energy is still available after a launching.

In the case where "burst" launching capacities are desirable, it is necessary to provide a coil able to store a significant energy. This poses no problem of implementation and even has an advantage: the bigger the supply coil is, the more important its coupling with the launcher can be made, which ultimately improves the launching efficiency.

Finally, the potential benefits generated by a multi-gun configuration are important, in terms of improving the coupling and thus the launching efficiency, as well as in terms of magnetic signature of the system.

The invention claimed is:

1. A rail launcher comprising at least two longitudinal rails connected to a power supply circuit of these two rails, these rails being at least partially surrounded by superconductor elements to generate a magnetic induction of a direction perpendicular to the plane formed by the rails and located therebetween during the flow of a current therein, wherein said supply circuit comprises the superconductor elements.

2. The launcher according to claim 1, wherein the superconductor elements, the supply circuit and/or the rails are able to form a closed electrical circuit.

3. The launcher according to claim 1, wherein the superconductor elements are electrically connected to the supply circuit of the rails or to these two rails and able to simultaneously generate said magnetic induction during the flow of a current therein and to supply the rails with this current.

4. The launcher according to claim 1, comprising at least one current generator able to charge said superconductor elements.

5. The launcher according to claim 1, wherein the superconductor elements comprise at least one superconductor coil or at least one dipolar electromagnet.

6. The launcher according to claim 5, comprising at least one superconductor coil being, at least in part, in the shape of a loop.

7. The launcher according to claim 6, wherein the loop is in the shape of a planar or curved "○" or a FIG. 8 wound on itself.

8. The launcher according to claim 5, comprising at least one SMES-type superconductor coil.

9. The launcher according to claim 1, wherein each of the rails is segmented into at least two segments, the respective segments of one of the rails facing those of the other rail, thereby forming pairs of segments and, preferably at least one superconductor coil is associated to each of the pairs of segments, each pair of rails with its corresponding coil forming a module.

10. The launcher according to claim 9, comprising at least two modules, each comprising a pair of rails with its corresponding coil, these modules being arranged either in parallel or arranged coaxially in series.

11. The launcher according to claim 1, comprising a current generator able to supply the rails with current.

12. A projectile-launching process with an electromagnetic launcher comprising at least two longitudinal rails connected to a power supply circuit comprising superconductor elements of these two rails, these rails being at least partially surrounded by the superconductor elements to generate a magnetic induction of a direction perpendicular to the plane formed by the rails and located therebetween during the flow of a current I1 therein, said process comprising, during the launching of the projectile, the simultaneous following steps:

generating said current I1 within the superconductor elements, and injecting this current in said at least two rails.

13. The process according to claim 12, comprising a preliminary step to store energy in the superconductor elements from a current generator.

* * * * *